US009750664B2

(12) United States Patent
Palmer et al.

(10) Patent No.: US 9,750,664 B2
(45) Date of Patent: Sep. 5, 2017

(54) INFANT DRINKING DEVICE

(71) Applicant: KONINKLIJKE PHILIPS N.V., Eindhoven (NL)

(72) Inventors: Jason Palmer, Eindhoven (NL); Bart-Jan Zwart, Eindhoven (NL); Christopher John Huff, Eindhoven (NL)

(73) Assignee: KONINKLIJE PHILIPS N.V., Eindhoven (NL)

( * ) Notice: Subject to any disclaimer, the term of this patent is extended or adjusted under 35 U.S.C. 154(b) by 188 days.

(21) Appl. No.: 14/394,761

(22) PCT Filed: Mar. 14, 2013

(86) PCT No.: PCT/EP2013/055221

§ 371 (c)(1),
(2) Date: Oct. 16, 2014

(87) PCT Pub. No.: WO2013/156213

PCT Pub. Date: Oct. 24, 2013

(65) Prior Publication Data

US 2015/0060386 A1 Mar. 5, 2015

(30) Foreign Application Priority Data

Apr. 18, 2012 (EP) ..... 12164599

(51) Int. Cl.

| | |
|---|---|
| ***A61J 11/02*** | (2006.01) |
| ***A61J 11/04*** | (2006.01) |
| ***A61J 9/04*** | (2006.01) |

(52) U.S. Cl.
CPC ..... *A61J 11/02* (2013.01); *A61J 9/04* (2013.01); *A61J 11/04* (2013.01)

(58) Field of Classification Search
CPC ..... A61J 11/00; A61J 11/001–11/002; A61J 11/0015; A61J 11/0035;
(Continued)

(56) References Cited

U.S. PATENT DOCUMENTS 1,146,639 A * 7/1915 Miller ..... A61J 9/04 215/11.5
2,174,361 A * 9/1939 Condon ..... A61J 11/0065 215/11.5
(Continued)

FOREIGN PATENT DOCUMENTS

EP 0587505 A1 3/1994

*Primary Examiner* — Chun Cheung
*Assistant Examiner* — Brijesh V. Patel

(57) ABSTRACT

To provide an infant drinking device with a more reliable aerator, the infant drinking device comprises a teat, a reservoir for holding a liquid, a connector for detachably connecting the reservoir to the teat, and an aerator. The aerator (e.g., a duckbill valve) includes a deformable opening (e.g., a slit) whereby internal/external pressure differential during use of the device is reduced in an open position of the opening by allowing air to enter through the opening into the reservoir and such that leakage of fluid from an inside of the drinking device to an outside of the drinking device is hindered in a closed position of the opening. During assembly of the teat, connector and reservoir, a minimally defined deformation of the opening of the aerator is enforced by at least one of a geometrical property and a material property of the teat or the connector.

9 Claims, 5 Drawing Sheets

(58) Field of Classification Search
CPC ..... A61J 11/004–11/006; A61J 11/0065; A61J 11/008; A61J 11/0085; A61J 11/04; A61J 11/045; A61J 17/00; A61J 9/00; A61J 9/006; A61J 9/04; A61J 9/06; A61J 9/0623
USPC ..... 215/11.1–11.6; 222/490; 606/234–236; D24/194, 196–198
See application file for complete search history.

(56) References Cited

U.S. PATENT DOCUMENTS 2,616,581 A * 11/1952 Madsen ..... A61J 11/008 215/11.5
3,593,870 A * 7/1971 Anderson ..... A61J 11/02 215/11.5
3,722,728 A * 3/1973 Yazaki ..... A61J 11/02 215/11.4
4,505,398 A * 3/1985 Kesselring ..... A61J 11/0035 215/11.5
4,993,568 A * 2/1991 Morifuji ..... A61J 11/002 215/11.1
5,101,992 A 4/1992 Serre
6,883,672 B2 * 4/2005 Dunn ..... A61J 9/00 215/11.1
8,640,897 B2 2/2014 Samson
8,708,174 B2 4/2014 Itzek
2004/0188373 A1 * 9/2004 Lewis ..... A61J 11/045 215/11.5
2005/0252875 A1 * 11/2005 Sheu ..... A61J 11/02 215/11.5
2007/0102388 A1 * 5/2007 Lewis ..... A61J 11/0015 215/11.1
2007/0131637 A1 * 6/2007 Tamura ..... A61J 11/004 215/11.1
2009/0200257 A1 * 8/2009 McKendry ..... A61J 9/04 215/11.5
2010/0163508 A1 * 7/2010 Samson ..... A61J 11/02 215/11.5
2012/0175335 A1 * 7/2012 Itzek ..... A61J 11/04 215/11.1
2012/0265245 A1 * 10/2012 Yamashita ..... A61J 11/0065 606/236
2014/0124469 A1 * 5/2014 Richard ..... A61J 11/02 215/11.5

* cited by examiner

State of the Art

INFANT DRINKING DEVICE

This application is the U.S. National Phase application under 35 U.S.C. §371 of International Application No. PCT/IB2013/055221, filed on Mar. 14, 2013, which claims the benefit of European Application No. 12164599.8 filed on Apr. 18, 2012. These applications are hereby incorporated by reference herein.

FIELD OF THE INVENTION

The invention relates to an infant drinking device, comprising a teat, a reservoir for holding a liquid, the reservoir being detachably connected to the teat by a connector of the infant drinking device, and an aerator, or alternatively indicated as a vent valve, such as a duckbill valve, the aerator thereto comprising a deformable opening, for example a slit, such that an internal/external pressure differential during use of the device is reduced in an open position of the opening by allowing air to enter through the opening into the reservoir and such that leakage of fluid from an inside of the drinking device to an outside of the drinking device is hindered in a closed position of the opening, wherein the aerator is included in the connector or the teat.

BACKGROUND OF THE INVENTION

Infant drinking devices are generally known. Such devices often include an aerator. This allows the entry of atmospheric air back into the bottle, as the infant drinks fluid from the device and creates an underpressure inside the reservoir. The underpressure inside the reservoir causes the aerator or valve to open. The aerator thereto has an opening, which is for instance created by cutting a slit in flexible material of the aerator through which opening air can pass to overcome the effects of negative pressure inside the reservoir. On the one hand the opening should ensure that air can pass to the inside of the reservoir as explained here before, but on the other hand leakage of fluid from the reservoir to the outside of the device should be avoided as much as possible. Another known problem of such drinking devices is that the aerator may become stuck quite easily, thereby compelling the caretaker to intervene and clear up the aerator. This may be a rather tiresome clean-up chore, especially when the reservoir is still filled and the inside of the teat being moisturized with liquid. The intervention of the caretaker may also influence the hygienically prepared milk or other fluid negatively. Besides it is inconvenient for the baby who cannot extract milk or any other fluid from the bottle anymore, as air inflow in the bottle is prevented by the stuck valve and as the teat has to be removed from his mouth thereafter by the caretaker to clear up the aerator. When the teat blocks or is removed from the baby's mouth, many babies start crying. This makes parents often nervous.

EP 1 863 427 A1 discloses a teat for a feeding bottle having a one-way valve located in the skirt of the teat to allow to enter the feeding bottle to replace liquid sucked out of the bottle through the nipple while preventing liquid from leaking from the bottle.

SUMMARY OF THE INVENTION

It is an object of the invention to provide an infant drinking device of the kind as set forth in the opening paragraph having a more reliable aerator.

According to the invention this object is realized in that a temporary deformation of the opening of the aerator into the open position is enforced by the geometrical and/or material properties of the teat-connector combination during assembly of the teat, connector and reservoir.

The problem which is addressed by the invention is that the slit may become stuck occasionally with residue left from the previous feeds. Such may occur for instance when the device was not cleaned properly or after storage. The opening usually has faces of silicone such as LSR that touch each other in a disassembled state of the drinking device. The faces may be stuck together for instance when dried-in baby instant or milk powder is left between the faces thereby sticking the faces together such that the faces of the opening cannot clear when reduction of the pressure difference is required during drinking. Also it may be possible that the faces are affixed to each other by cohesion forces caused by the material itself.

Well then, a minimally defined deformation of the opening causes the dried-in residues to crumble or causes the stuck faces to loosen, thereby setting free the opening. If such a deformation is systematically brought about, every time that the teat, the connector and the reservoir are assembled, the aerator can function more reliable. After assembly the drinking device starts off with a cleared aerator, regardless if the opening was stuck or not before assembling the device. This mechanism of systematically clearing the opening considerably avoids disassembling the teat, the connector and the reservoir to a great extent.

On assembly of the drinking device, the connector tightly holds the reservoir and the teat together. Under influence of the assembly forces the teat and/or the connector will deform. The aerator is included in the teat or in the connector. The material and geometrical properties of the teat and the connector determine the deformation that is provided and required for assembly. By adapting the geometry of the combination of connector and teat such, that the opening of the aerator also deforms during assembly, the aerator is reset thus ensuring good performance from the teat and feeding bottle system.

In an advantageous embodiment of the drinking device the aerator is included in the teat wherein the connector is more rigid than the teat, wherein the connector contributes to prevention of leakage through the aerator by accommodating the aerator sufficiently close to the connector in an assembled state of the drinking device. The teat is in contact with the mouth of the drinking infant at the outside and liquid is in contact with the inside of the teat. Therefore, it is of utmost hygienic importance that the teat is properly cleaned after every use. The aerator may likely get in contact with the liquid during use as a part of its function is to avoid leakage of said liquid. By including the aerator in the teat, the aerator will be cleaned with the same frequency as the teat. By arranging the connector close to the aerator the stiffness properties of the aerator may be attuned in assembled state to obtain a sufficiently reliable and stable aerator with a good anti-leakage behavior.

In an advantageous embodiment according to the invention the aerator is monolithically included in the teat and the teat has a zone of reduced stiffness in which zone the aerator is accommodated. Under the action of the forces which are present during assembly of the teat, the connector and the reservoir, the zone of reduced stiffness will deform relatively more in relation to other parts of the teat. This deformation of the zone of reduced stiffness better enables a transfer deformation to the opening of the aerator. The teat and the aerator can be manufactured for instance by injection molding. The geometry of the monolithic teat can be designed to create the zone of reduced stiffness for instance by accommodating the aerator in or near a zone of reduced wall thickness. The skilled person will know other ways to provide a decrease in local stiffness of the zone.

In a very advantageous embodiment of the drinking device according to the invention the teat has a suction portion which is suitable for entering into the mouth of an infant for feeding, and a connector portion which is suitable for interacting with the connector and/or the reservoir for assembly of the teat to the reservoir, wherein the aerator is arranged outside the suction portion. By arranging the aerator outside the suction portion, the teat can be moved around by the infant or parent during feeding, while its function is not affected.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
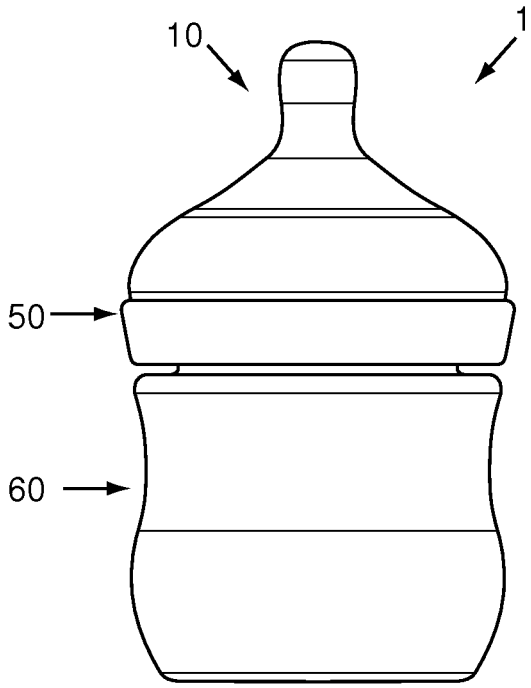
FIG. 1 is a schematic side view of an infant feeding bottle according to the present invention.

FIG. 1 depicts a schematic side view of an infant feeding bottle 1 according to the invention. The bottle 1 has a reservoir 60, a connector 50, and a resilient teat 10. The reservoir 60 can hold a liquid for instance infant food. The reservoir includes an upper portion provided with an outer screw thread onto which the connector can be attached in a manner which is known to the skilled person. The teat 10 and the reservoir 60 are connected by the connector 50.

Figure 2A:
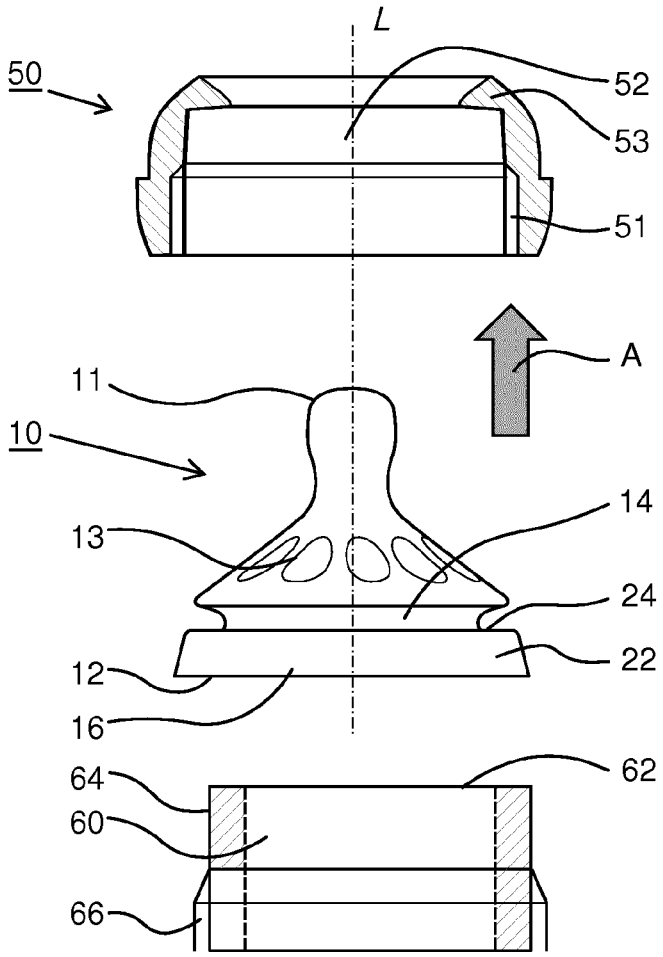
FIG. 2A schematically shows a side view of the exemplary embodiment of the teat and the connector shown in FIG. 1.

FIG. 2A schematically shows a side view of the embodiment of FIG. 1 prior to assembling the teat 10, connector 50 and reservoir 60. The teat has a top 11, a bottom 12, a suction portion 13 on which the baby sucks or moves its mouth to extract milk from the infant feeding bottle 1 and a connection portion 14 which is designed for connecting the teat to the connector 50 and subsequently to the reservoir 60. When the teat 10 is connected to the reservoir 60, a skirt 22 of the teat 10 fits over an upper rim 64 of the reservoir 60. The connector 50 has an inner thread 51 which corresponds to an outer thread 66 of the reservoir 60. The teat 10 has an annular groove 24 configured to receive a rim 53 of the connector 50 fitting sealingly together as is known per se by the man skilled in the art. When screwing the connector 50 top the reservoir 60, the connector rotates around a rotational axis L. An arrow A indicates the direction wherein the teat 10, the connector 50 and the reservoir 60 are assembled together. First the teat 10 is pulled into the connector 50 in the direction of the arrow A, thereby deforming the teat 10 to force the rim 53 over the top side of the groove 24. Subsequently the connector is screwed onto the top part 64 of the reservoir 60 by means of inner thread 51 and outer thread 66. A top face 62 of the reservoir 60 is pressed against a sealing face 16 of the teat 10 in the assembled state to prevent leakage of fluid from the reservoir 60. The force which is required for the sealing of face 68 against face 16 is provided by tightening the connector 50 by means of the threaded portions 51 and 66.

Figure 2B:
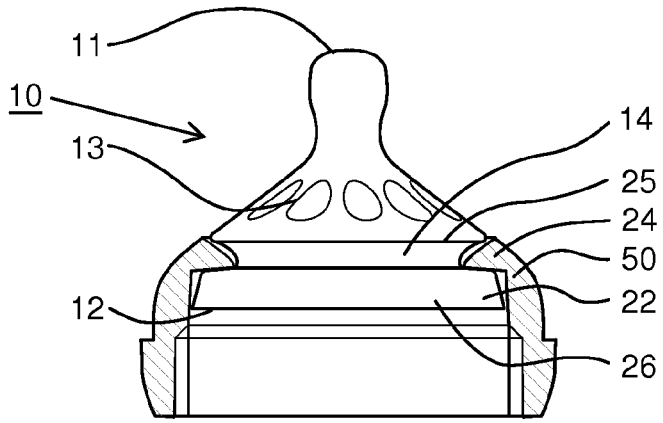
FIG. 2B schematically shows a combination of a side view of the exemplary embodiment of the teat and a cross-sectional view of the connector shown in FIG. 2A.

The skilled person will understand that other rotational configurations of the teat 10 and the reservoir 60 may be applicable, such as an oval shape of teat and reservoir or octagonal symmetries while yet using a round shape at the connection interface. Alternatively, instead of threaded portions, the clamping force may be provided by other means such as a snap fit connection or by means of external clamping mechanisms which are all per se known to the skilled person. The connector 50 has an inner passage 52 to allow liquid to pass through the connector 50 to the top 11 of the teat 10. FIG. 2B shows the teat 10 and the connector 50 in assembled state.

Figure 3A:
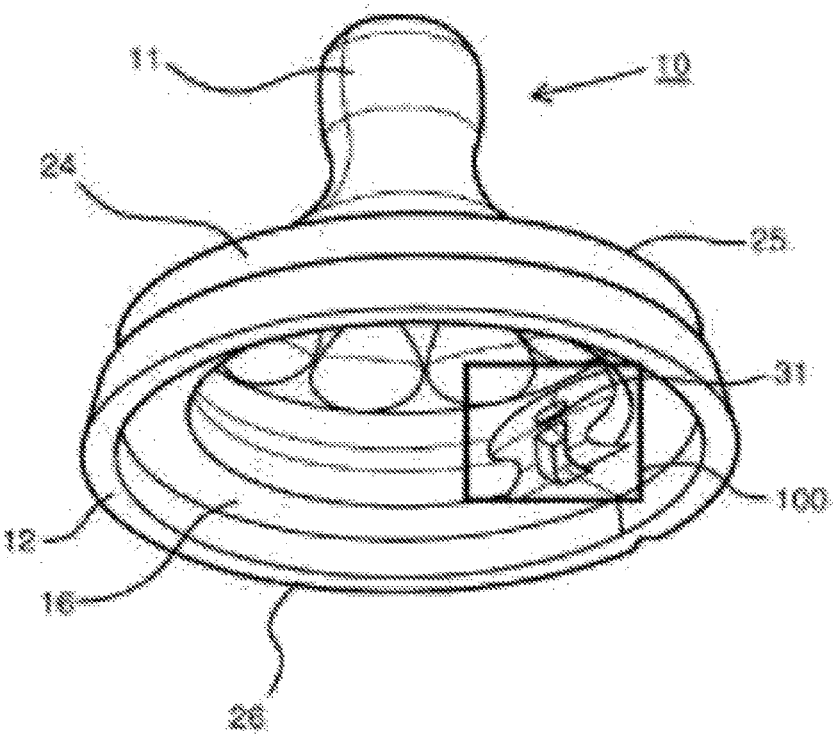
FIG. 3A schematically shows a bottom perspective view of the isolated exemplary embodiment of the teat shown in FIG. 1.

FIG. 3A schematically shows a bottom perspective view of the teat 10 as described here above and according to FIGS. 1 and 2. Rectangle 100 indicates a portion of the teat 10 wherein an aerator 31 is accommodated. An enlargement of the portion indicated in rectangle 100 is given in FIG. 3B. The aerator 31 has a duckbill valve 38 accommodated into a frame 39 of the aerator. The frame 39 is shaped as a thickened portion of frame 36 of the teat 10 and has a circumference similar to a guitar without a neck. The frame 36 is locally weakened by an upper recessed portion or recess 41 and a lower recess 42. Between the upper recess 41 and the lower recess 42 is accommodated a dam section 37 in the frame 39. The dam section has an opening in the form of a slit 35. The dam section 37 comprising the slit 35 form the duckbill valve of the aerator 31. Air from outside the bottle can enter to compensate a pressure difference between the inside and the outside of the bottle during use. A top face 32 and a bottom face 33 of the dam section 37 delimit the dam section 37 against both recesses 41 and 42 (see FIG. 3C).

Figure 3B:
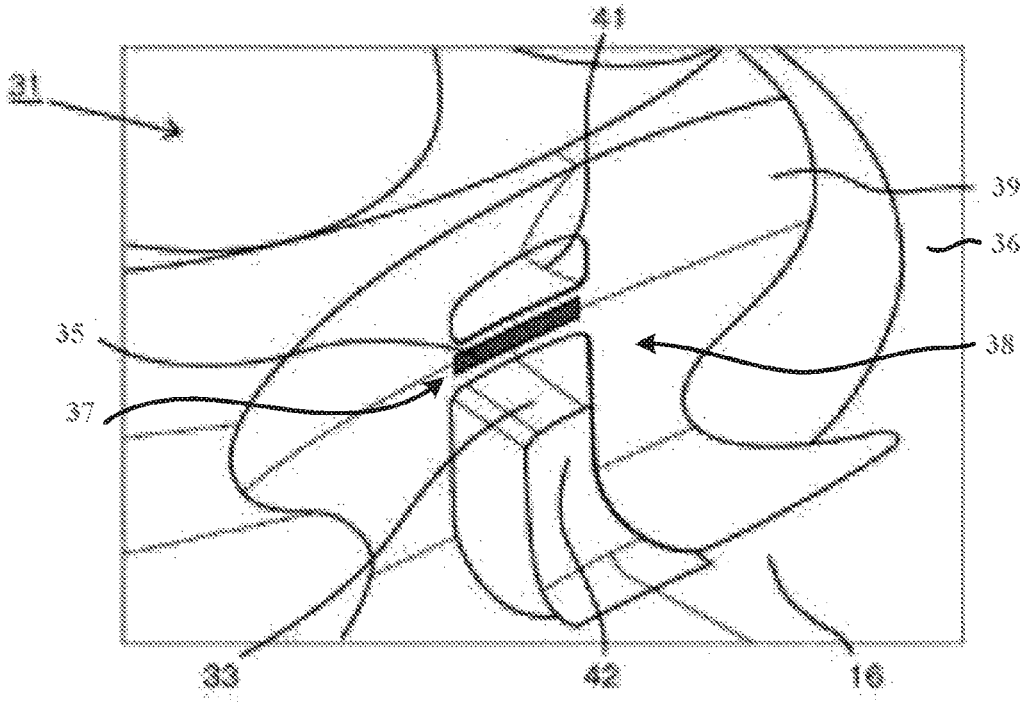
FIG. 3B schematically shows a detail of the bottom perspective view shown in FIG. 3A.
Figure 3C:
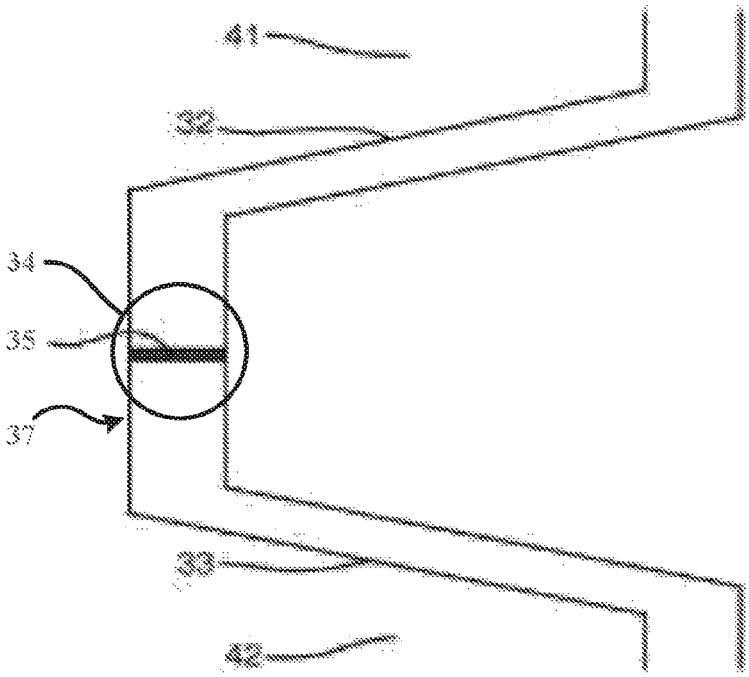
FIG. 3C is a cross section of a detail of FIG. 3B.

FIG. 3C is a cross section of a detail of FIG. 3B. The duckbill valve 38 and its slit 35 are in a configuration wherein the faces of the slit make contact in a zone of contact 34. This is the closed state of the duckbill valve 38. When an internal/external pressure differential is absent the slit 35 is closed and the top face 32 and its underlying material and the bottom face 33 and its underlying material abut against each other in the zone of contact 34 of the slit 35. When a baby sucks on the teat an internal/external pressure differential starts to be created by the removal of the milk from the bottle. Then the air outside the bottle forces the two faces 32, 33 of the duckbill valve to deform and move apart thereby clearing the zone of contact 34 of slit 35. Normally a threshold is present to the extent that the internal/external pressure differential has to exceed a specific value before the two faces 32, 33 are separated thereby causing disconnection in the zone of contact 34 to create a hole which allows the aerator 31 to vent the inside of the bottle, thus reducing the internal/external pressure differential.

Figure 4A:
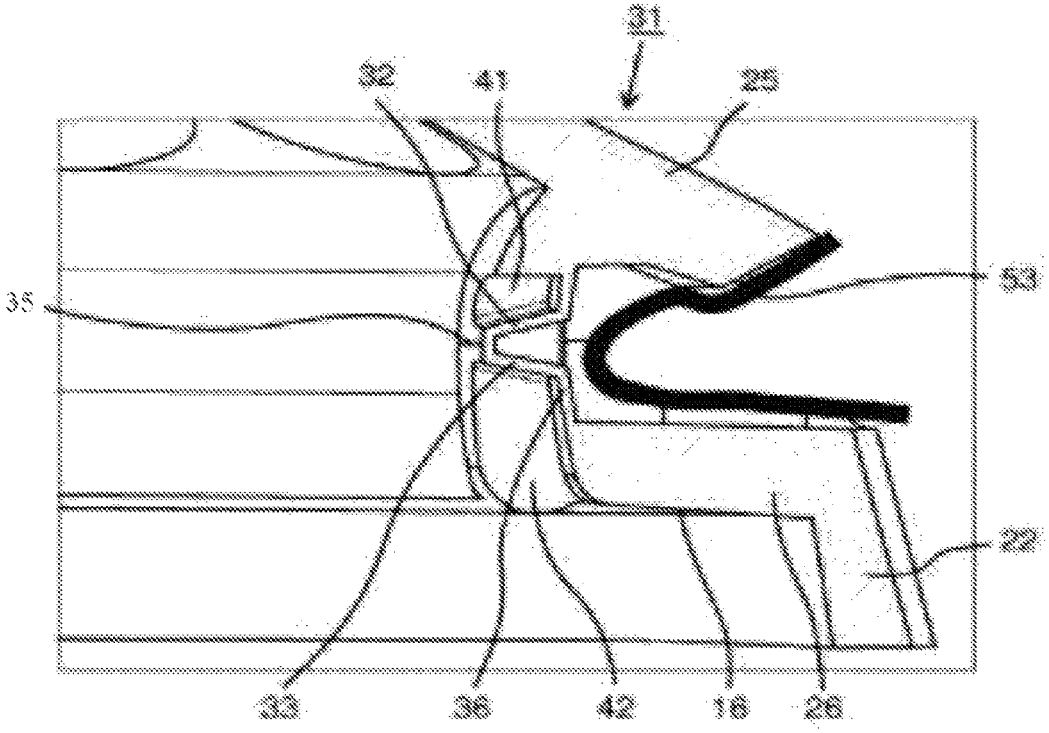
FIG. 4A schematically shows a cross-section of the embodiment according to the previous figures.

To further explain the pressure compensation mechanism a cross-sectional view of the detail presented in FIG. 3B is shown in FIG. 4A. In FIG. 4A the teat 10 comprising the duckbill valve 38 in the lower portion 14 are indicated. The duckbill valve 38 comprises the top face 32, the bottom face 33 and the opening in the form of the slit 35. The top face 32 and the bottom face 33 are separated by the slit and come together or abut at contact portion 34 (see FIG. 4A). As can be derived from FIG. 3A, the slit 35 of the duckbill valve 38 is oriented perpendicular to the longitudinal axis L.

When an internal/external pressure differential is absent the slit 35 is closed and the top face 32 and the bottom face 33 abut against each other and may connect at the internal faces or contact portion 34 of the slit 35. When a baby sucks drinks from the bottle an internal/external pressure differential is created by the removal of the milk from the bottle. Then the air outside the bottle forces the two faces 32, 33 to disconnect. When the internal/external pressure differential exceeds a specified value, the two faces 32, 33 are separated such that they disconnect thereby causing the opening 35 to create a hole which allows the aerator 31 to vent the inside of the bottle, thus reducing the internal/external pressure differential.

The faces 32, 33 of a silicone duckbill valve 38 have a tendency to stick to each other, mainly caused by the material properties of the material, silicone, and/or by residue from the previous feeds left between the two sidewalls. To overcome the sticking force the faces 32, 33 have to be enforced to separate. This can be done manually by, pressing for example a pencil between the two faces 32, 33, but this may introduce new bacteria or dirt into the hygienically prepared milk. Instead of pressing the two faces apart, they can also be pulled apart by applying a force perpendicular to the contact portion 34, i.e. in the direction of the longitudinal axis L. When connecting the teat 10 to the connector 50 a force perpendicular to the contact portion 34, i.e. along the longitudinal axis L, of the duckbill valve 38 is applied: the second clamp portion 26 of the teat 10 remains behind the connector 50 while first clamp portion 25 moves through the connector 50 and away from the connector 50. As can be seen from FIG. 2B, the diametrical dimensions of the connector 50 and the annular groove 24 match in an assembled state. However, when assembling the teat 10 to the connector 50, the teat 10 has to deform to allow the upper clamp portion 25 to pass through the connector 50. The specific deformation of the teat 10 is among others dependent from the geometrical and material properties of the teat. In this specific embodiment the arrangement of the aerator 31 is such that a folding deformation is enforced in the thickened portion around the aerator 31 by means of the upper and lower recesses 41 and 42. The recesses 41, 42 now function as weakening means to enforce deformation. As a result the contact portion 34 of the slit moves apart thereby clearing the duckbill valve 38. This is an important advantage over the currently available teats.

FIG. 4A schematically shows a cross-sectional view of the teat 10 according to the previous figures and according to the invention. Prior to explaining the execution of the aerator of FIG. 4A first a state of the art aerator will be explained which state of the art aerator is depicted in FIG. 4B.

Figure 4B:
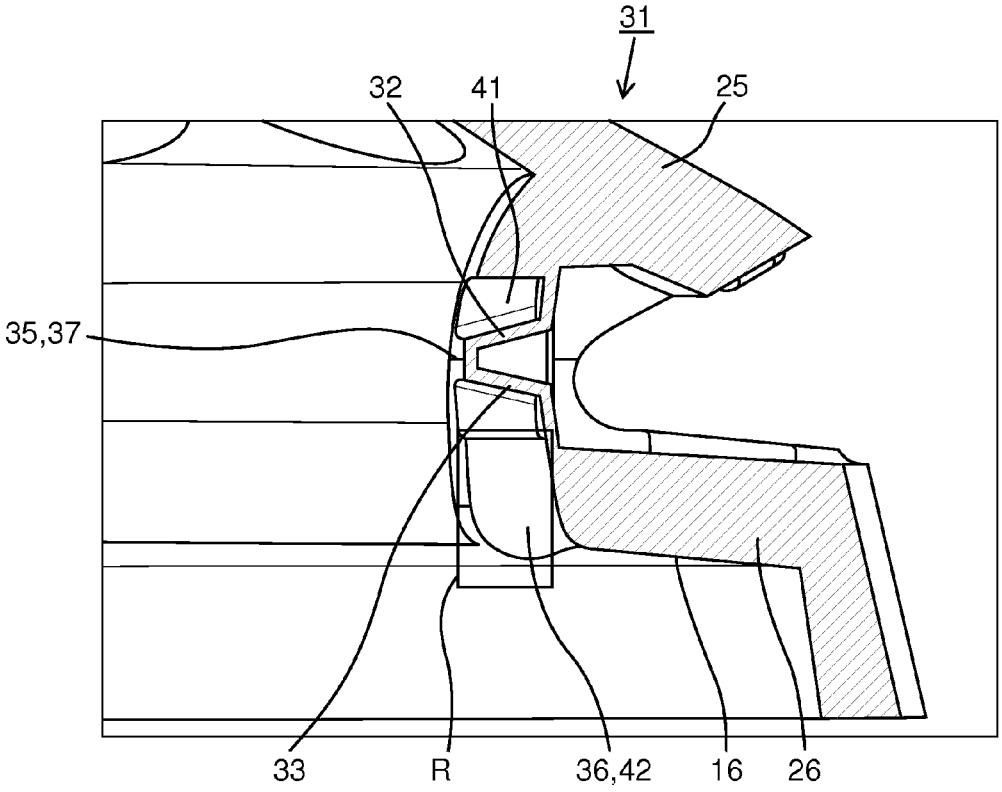
FIG. 4B shows a detail of the cross-section of a state of the art valve.

In FIG. 4B a rectangle R is indicated. The material of the teat extends into the rectangle R and the frame 36 is stiffened by the presence of material in rectangle R. The material inside the rectangle R contributes to the stability of the valve. This prevents leakage of fluid from inside the bottle. In the arrangement according to FIG. 4A the material inside the rectangle R depicted in FIG. 4B has been removed. The frame in which the duckbill valve is arranged is weakened which contributes to a better clearance of the valve according to an object of the invention. This stability of the valve—which is required to prevent leakage—is now further improved by the connector rim 5 by accommodating the duckbill valve sufficiently close to the rim 53 of connector 50 in an assembled state of the drinking device 1.

The amount of material removed in the embodiment according to FIG. 4A is such that no material is present between face 33 and the top face 62 of the reservoir. The skilled person will understand that less material can be removed to the extent that the clearance behavior of the aerator is sufficient according to an object of the invention. The skilled person will understand that for instance also the material can be removed up until half of the distance between the top face of the reservoir and the bottom face 33 of the duckbill valve and that a better execution will be reached if this level is decreased to one third of said distance or one fourth. If all the material is removed the clean ability of the valve is increased because there are less edges available where fluid food may be caught. When removing more material the rim of the connector has to be arranged more closely towards the weakened portion to restore the stiffness of the frame which is needed to stabilize the valve to prevent leakage during use.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

The skilled person will appreciate that the present invention is not limited to the specific embodiments. For example the connection portion may also be weakened around the aerator, causing the connection portion to deform in a longitudinal direction rather than in a folding like pattern when a longitudinal force is applied. This may likewise cause a clearance of the aerator during assembly.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

Other modifications and variations falling within the scope of the claims hereinafter will be evident to those skilled in the art.

The invention claimed is:

1. An infant drinking device, comprising:

a teat;

a reservoir for holding a liquid;

a connector for detachably connecting the teat to the reservoir, wherein an assembled state of the infant drinking device is a detachable connection by the connector of the teat to the reservoir; and an aerator included in at least the teat, wherein the aerator includes a deformable opening movable between a closed position and an open position in response to a differential between an internal pressure and an external pressure of the assembled state of the infant drinking device, wherein the open position of the deformable opening allows air to enter through the deformable opening into the assembled state of the infant drinking device, wherein the closed position of the deformable opening hinders a leakage of fluid out of the assembled state of the infant drinking device, and wherein the deformable opening of the aerator is temporarily deformed to the open position in response to the teat being detachably connected by the connector to the reservoir during an assembly of the teat, the connector and the reservoir; and wherein at least one of a geometrical property and a material property of the teat or the connector enforces the temporary deformation of the deformable opening to the open position in response to the teat being detachably connected by the connector to the reservoir.

2. The infant drinking device according to claim 1, wherein the aerator is included in the teat;

wherein the connector is more rigid than the teat; and wherein the connector contributes to prevent leakage of fluid through the aerator by accommodating the aerator sufficiently close to the connector in the assembled state of the infant drinking device.

3. The infant drinking device according to claim 2, wherein the aerator is monolithically included in the teat;

wherein the teat has a zone of reduced stiffness which will deform relatively more in relation to other parts of the teat, and wherein the aerator is accommodated in the zone.

4. The infant drinking device according to claim 3, wherein the teat includes a suction portion which is suitable for entering into a mouth of an infant for feeding, and a connection portion which is suitable for interacting with at least one of the connector and the reservoir in the assembled state of the infant drinking device; and wherein the aerator is arranged outside the suction portion.

5. The infant feeding device according to claim 4, wherein the connector is ring-shaped;

wherein the teat is configured to be pulled through the connector;

wherein the connection portion includes the zone of reduced stiffness; and wherein the zone of reduced stiffness enforces a temporary deformation of the deformable opening to the open position in response to the teat being detachably connected by the connector to the reservoir.

6. The infant feeding device according to claim 5, wherein the teat has a seal face for abutting and sealing against a top face of the reservoir in the assembled state of the infant drinking device;

wherein the teat is provided with an annular groove cooperating with a rim at the inside of the connector in the assembled state of the infant drinking device;

wherein the aerator is arranged in the annular groove; and wherein a recess is provided extending in the assembled state of the infant drinking device between the top face of the reservoir and a bottom face of the aerator.

7. The infant feeding device according to claim 1, wherein the aerator includes a duckbill valve.

8. The infant feeding device according to claim 1, wherein the deformable opening includes a slit.

9. The infant feeding device according to claim 1, wherein the deformable opening is oriented perpendicular to a longitudinal axis of the teat.

* * * * *